US006405443B1

(12) United States Patent
Thorn et al.

(10) Patent No.: US 6,405,443 B1
(45) Date of Patent: Jun. 18, 2002

(54) GEOMETRIC CONSTRUCTION DEVICE

(75) Inventors: Joseph P. Thorn, Lake Villa, IL (US); Kevin J. Anderson, Kenosha, WI (US)

(73) Assignee: A. Daigger & Company, Inc. ETA Division, Vernon Hills, IL (US)

( * ) Notice: Subject to any disclaimer, the term of this patent is extended or adjusted under 35 U.S.C. 154(b) by 0 days.

(21) Appl. No.: 09/552,502

(22) Filed: Apr. 19, 2000

(51) Int. Cl.[7] ..... B43L 9/04
(52) U.S. Cl. ..... 33/27.03; 33/471
(58) Field of Search ..... 33/27.02, 27.03, 33/27.01, 27.031, 27.032, 27.033, 484, 485, 489, 678, 666, 465, 471

(56) References Cited

U.S. PATENT DOCUMENTS

| | | | | | |
|---|---|---|---|---|---|
| 2,054,420 | A | * | 9/1936 | Hochman | 33/27.01 |
| 2,612,690 | A | * | 10/1952 | Cotton | 33/27.03 |
| 2,857,674 | A | * | 10/1958 | Feldhake | 33/27.03 |
| 3,791,036 | A | * | 2/1974 | Stober, Jr. et al. | 33/27.03 |
| 4,267,638 | A | * | 5/1981 | Heinz | 33/27.03 |
| 5,615,485 | A | * | 4/1997 | Stoneberg | 33/27.03 |
| 5,987,760 | A | * | 11/1999 | Hsu | 33/27.03 |

OTHER PUBLICATIONS

Compass/Protractor manufactured by NES Arnold as shown in Photograph 1, No Date.

Compass/Protractor manufactured by IMG as shown in Photograph 2, No Date.

Compass/Protractor manufactured by ETA/Cuisenaire (ETA) as shown in Photograph 3, No Date.

Compass/Protractor manufactured by Safe–T as shown in Photograph 4, No Date.

Compass/Protractor manufactured by Safe–T as shown in Photograph 5, No Date.

Compass/Protractor manufactured by NES Arnold as shown in Photograph 6, No Date.

* cited by examiner

*Primary Examiner*—Christopher W. Fulton
(74) *Attorney, Agent, or Firm*—Michael Best & Friedrich LLC; Larry L. Saret; Lisa C. Childs

(57) ABSTRACT

A geometric construction device forms circles or arcs with a marking instrument and simultaneously measures angles. The device includes a radius arm and a rotatable member. The radius arm includes a means for receiving the marking instrument and a disc having a pivot point and being rotatable about the pivot point. The disc is used to attach the rotatable member to the radius arm. The rotatable member in combination with the radius arm forms a 360° protractor. The rotatable member has a plurality of radius holes in it for receiving the marking instrument. These radius holes may be used to form circles or arcs with the radius being less than or equal to the radius of the disc. The 360° protractor is capable of measuring degrees between 0° and 360° while circles or arcs are being formed.

18 Claims, 3 Drawing Sheets

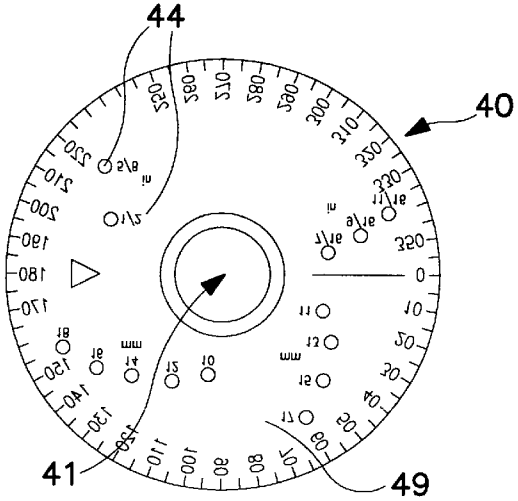
FIG. 8
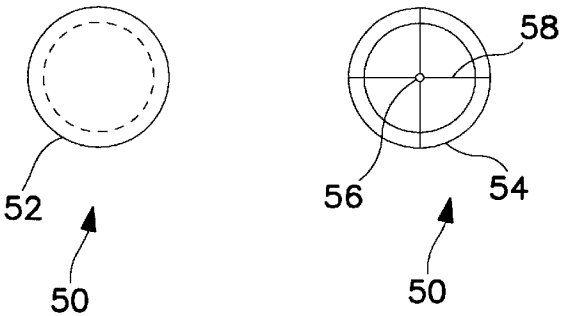
FIG. 9B
FIG. 9A
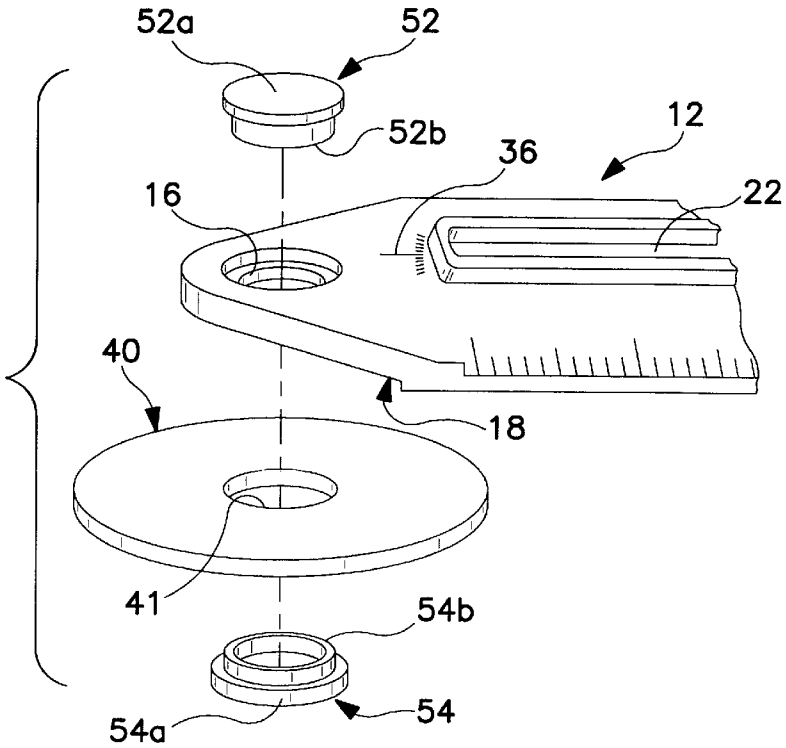
FIG. 6
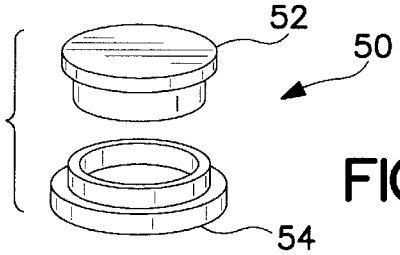
FIG. 7

GEOMETRIC CONSTRUCTION DEVICE

This invention relates to drawing arcs, circles and lines and measuring angles and in particular, devices for accomplishing these tasks.

BACKGROUND OF THE INVENTION

There are known devices for either drawing arcs and forming circles or for measuring and laying down angles, and there are some which are capable both of measuring angles and forming arcs and circles. However, these devices are unsuitable for the simultaneous drawing and measuring of an arc. Moreover, the known devices that can be used to form circles cannot readily measure angles beyond 180°.

Consequently, a need exists for a device which can be used to simultaneously draw and measure an arc and at any angle from 0° to 360°.

Accordingly, an object of this invention is to provide a device which can simultaneously draw and measure an arc having one of an infinite number of possible radii and at any angle from 0° to 360°.

SUMMARY OF THE INVENTION

The invention generally relates to a device for geometric construction with a marking instrument. The device comprises a radius arm, which includes a means for receiving the marking instrument and a disc having a pivot point, and a rotatable member attached to the radius arm around the disc, the rotatable member being movable through 360° about said disc and having indicia for measuring degrees between 0° and 360°.

In a preferred embodiment, the device has a radius arm and a rotatable member, which are rotatably attached by means of a disc. The radius arm includes this disc, which has a pivot point, and a means for receiving the marking instrument. The receiving means is adjustably spaced from the pivot point and further comprises an elongated opening within the radius arm. The elongated opening has a length and two straight edges substantially parallel with the elongated opening. The radius arm has measuring indicia along at least one of the two straight edges. A sliding member which is movable along the length of the elongated opening is also part of the radius arm. The sliding member includes at least one, and preferably two, pairs of pointers and at least one, and preferably two, holes for receiving the marking instrument, with each of said holes between a pair of pointers. The pairs of pointers indicate one of the measuring indicia. The sliding member further comprises a locking means to hold the sliding member in place along the elongated opening. The device also includes a rotatable member attached to the radius arm around the disc. The rotatable member is movable through 360° about the disc and has indicia for measuring degrees between 0° and 360°. The rotatable member further includes at least one radius hole in it for receiving the marking instrument. The disc comprises a top part and a bottom part, with the top part and the bottom part rotatably attaching together the rotatable member and the radius arm.

BRIEF DESCRIPTION OF THE DRAWINGS

FIG. 6 is an exploded view of a portion of the invention, showing how the rotatably attached member and the radius arm are assembled.

FIG. 7 is a perspective view of the disassembled disc.

FIG. 8 is a bottom plan view of the rotatably attached member of the invention.

FIG. 9 has two views, in which FIG. 9A is a top plan view of the disassembled disc, and FIG. 9B is a bottom plan view of the disassembled disc.

DETAILED DESCRIPTION OF THE INVENTION

Figure 1:
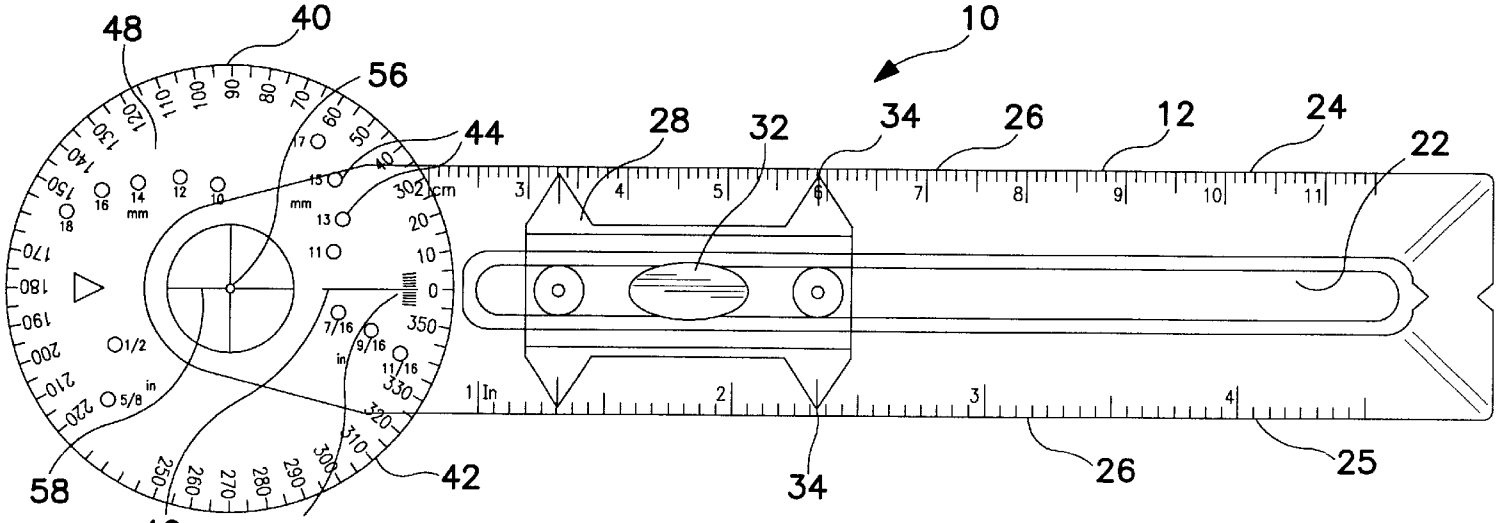
FIG. 1 is a top plan view of the invention.

Generally referring to FIGS. 1–9, the invention 10 is a device capable of forming circles or arcs with a marking instrument and simultaneously measuring angles. The device 10 comprises a radius arm 12 and a rotatably attached circular member 40 attached together via a connecting disc 50. The circular member 40 is capable of acting as a 360° protractor and of drawing circles or arcs of fixed radii. The radius arm 12 is capable of drawing circles or arcs of radii selected by the user as well as measuring and drawing lengths. The circular member 40 and the radius arm 12 share a rotational axis or pivot point 56 located in the center of the disc 50, so that a user can draw concentric circles, some of predetermined radii and others of user-selected radii. The device, especially the rotatably attached circular member 40, is preferably substantially transparent to facilitate measuring angles and drawing circles or arcs in selected locations.

Figure 5:
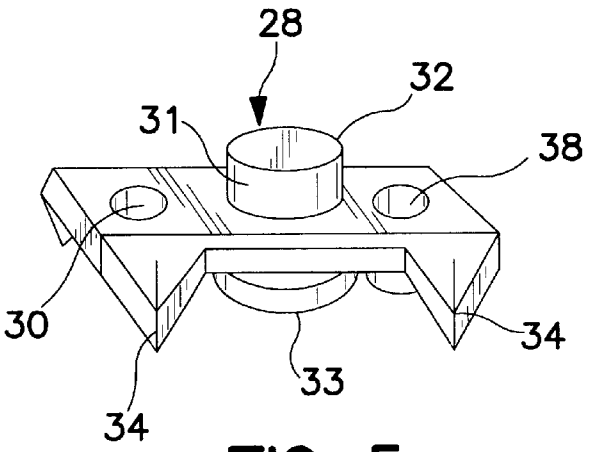
FIG. 5 is a side elevation view of the sliding member of the invention.

As best seen in FIGS. 1, 2, 4 and 5, the radius arm 12 further comprises a sliding member 28 for receiving the marking instrument. The sliding member 28 is received in a centrally located slot or elongated opening 22 in the radius arm 12. As best seen in FIG. 5, the sliding member 28 has holes 30, 38 for receiving a marking instrument such as a pen or pencil and a locking means 32. The locking means permits the sliding member to be fixed anywhere along the length of the slot 22.

In a preferred embodiment, the locking means 32 comprises a screw 31 and nut 33, but it should be recognized that other means capable of releasably fixing the sliding member 28 to the radius arm 12 could be used. The screw 31 of the locking means 32 can be turned in one direction (e.g., counterclockwise) to release the locking means sufficiently to permit the sliding member 28 to slide along the elongated opening 22. The screw 31 of the locking means 32 can also be turned in a second direction (e.g., clockwise) to lock the locking means in place to secure the sliding member 28 and prevent it from sliding. In a still more preferred embodiment, the screw 31 of the locking means 32 can be turned only part-way in either direction, enough to allow or prevent sliding but not enough to result in the disassembly of the locking means 32.

Figure 2:
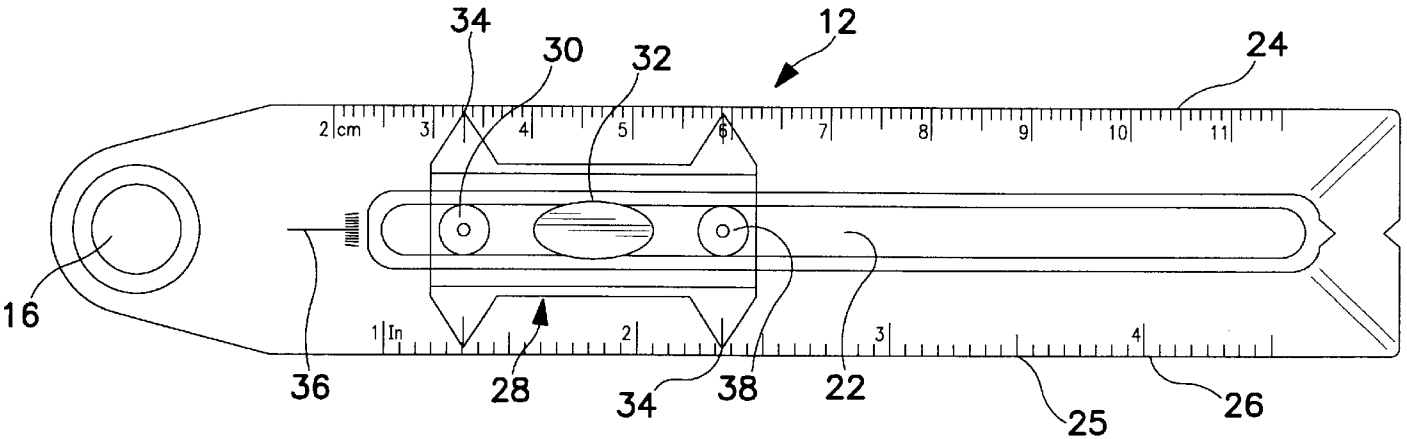
FIG. 2 is a top plan view of the radius arm of the invention.
Figure 3:
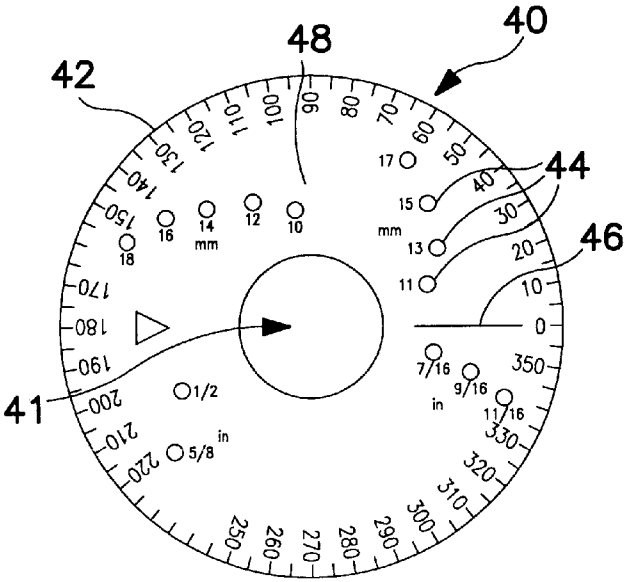
FIG. 3 is a top plan view of the rotatably attached member of the invention.
Figure 4:
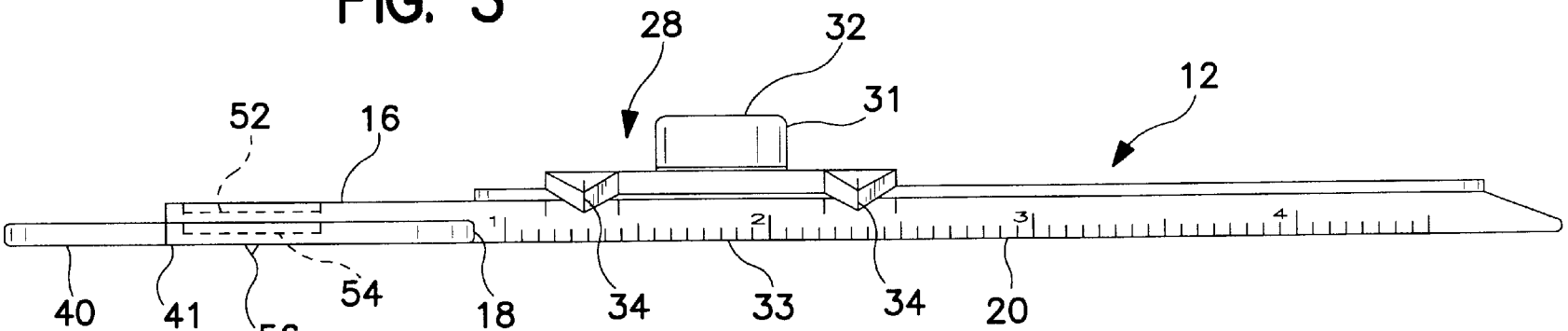
FIG. 4 is a side elevation view of the invention.

As seen in FIG. 2, the radius arm 12 further comprises two straight edges 24 and 25, substantially parallel with each other and with the elongated opening 22. One or both of the two straight edges 24 and 25 may have measuring indicia 26 provided thereon. The measuring indicia 26 may be, for example, English units or metric, or English on one straight edge and metric on the second straight edge as seen in FIGS. 1 and 3. The invention is thus capable of acting as a ruler.

In a preferred embodiment, the zero point for the ruler is at the pivot point 56 of the disc 50 and can be readily located by using the crosshairs 58. Additionally, the pivot point 56 is preferably a bump or provides some other tactile indication of engagement with the surface.

The sliding member 28 further has a plurality of pointers 34, two of which are collinearly aligned with hole 30 and two collinearly aligned with hole 38 in the member 28. The two holes 30, 38 are spaced apart from each other and located near the longitudinal ends of sliding member 28.

A first pointer of each pair points to the measuring indicia 26 on the first long straight edge 24 and the second pointer of each pair points to the measuring indicia 26 on the second long straight edge 25. When the measuring indicia is English on one straight edge and metric on the second straight edge, the two opposite pointers of each pair may be used to convert English to metric and vice versa. The indicia 26 indicate the radial or linear distance from the pivot point 56 to a pointer.

Connecting disc 50 and rotatable circular member 40 are concentric, with the pivot point 56 at their center. The connecting disc 50 and the radius arm 12 are both rotatable about the pivot point 56.

As seen in FIGS. 6, 7 and 9, disc 50 is made up of a top part 52 and a bottom part 54, each of which are mushroom-shaped with caps 52*a* and 54*a,* respectively, and stems 52*b* and 54*b,* respectively. The top part 52 and bottom part 54 preferably snap fit together, with the stem 52*b* received inside the stem 54*b*. The tactile pivot point 56 is located in the center of cap 54*a*. Cap 54*a* also has crosshairs 58 centered on the pivot point 56. Preferably, the pivot point 56 and crosshairs 58 can be seen by the user through the top part 52.

Rotatable circular member 40 has a centrally-located hole 41 and the radius arm 12 has a hole 16 near one end to receive disc 50. It is preferred that the radius arm 12 have a notch or cutout 18 on its bottom side 20 of sufficient depth to accommodate the circular member 40 so that the circular member 40 can rotate freely underneath the radius arm 12 while allowing the assembled device 10 to lie flat on the marking surface during use. In other words, radius arm 12 has a reduced thickness starting at notch 18 which is of a length slightly larger than the radius of circular member 40 and a height slightly greater than the thickness of circular member 40. When the top part 52 and the bottom part 54 of the disc 50 are snapped together through holes 16 and 41, the radius arm 12 and the circular member 40 are rotatably attached.

Preferably, the disc 50 is transparent so that the pivot point 56 and the crosshairs 58 can be seen from the top of the assembled device 10. It is also preferred that the device is assembled so that the radius arm 12 is above the circular member 40 during use although the device could be readily designed so as to work when assembled in reverse order by simply printing indicia 26 to be readable for that assembly.

The rotatably attached circular member 40 rotates independently of the radius arm 12, although they share the common rotational axis about pivot point 56. As seen in FIGS. 1 and 3, the rotatably attached circular member 40 preferably has a plurality of radius holes 44 extending through it between the top surface 48 and bottom surface 49 to receive a marking instrument such as a pencil or pen. Each of the radius holes 44 are fixed at a different radial distance from pivot point 56.

Arcs or circles with relatively small radii can be drawn using circular member 40. When a marking instrument is inserted into one of the plurality of radius holes 44 in circular member 40 and the pivot point 56 is held by a finger firmly against an underlying surface, an arc or circle of any radius can be drawn by moving the marking instrument in a clockwise or counterclockwise motion. To complete a circle or arc by using the radius holes 44, it may be necessary to also rotate the radius arm 12 by pushing it out of the way with the marking instrument as it simultaneously moves circular member 40. The radius of such an arc or circle is fixed by the location of the radius hole in the circular member 40.

Arcs or circles with relatively large radii can be drawn using radius arm 12. The desired radius is selected by locking the sliding member 28 so that one of the pointers 34 is aligned with the indicia 26 indicating the desired radius. A marking instrument is then inserted in hole 30 or 38 of the radius arm 12 while the pivot point 56 is held by a finger firmly against an underlying surface. An arc or circle of a selected radius is drawn by moving the marking instrument and hence also radius arm 12, in a clockwise or counterclockwise motion.

The radius of the circle or arc having its center at the pivot point 56 and its circumference at the distance designated along the radius arm 12 by hole 30 or 38 can be measured by visually noting the distance indicated by pointer 34.

In contrast to the fixed radius holes 44, the holes 30 and 38 in the sliding member 28 may be used to form circles or arcs of infinite various radii determined by the user, limited only by longitudinal range of sliding member 28 within slot 22. In the more preferred embodiment shown, the radius of the rotatably attached circular member 40 is less than one inch and the hole 30 in the sliding member 28 may be used to draw a circle having radii between one and four and a half inches, although arcs and circles of other radii could be drawn by changing the dimensions of the radius arm or circular member.

As can be seen from FIGS. 1 and 2, having multiple holes in sliding member 28 allows formation of circles and arcs having radii along substantially the full length of the elongated opening 22. If only hole 30 were provided, for instance, then the radius of any circle or arc drawn with the invention would be less than the entire elongated opening because the hole 30 could not be positioned at the distal end of the elongated opening. Likewise, if only hole 38 were provided, then a user could not draw arcs or circles having radii near the proximal end of the elongated opening.

Both the rotatable circular member 40 and radius arm 12 also include indicia for measuring angles. The rotatably attached circular member 40 comprises indicia 42 indicating 360 degrees inscribed around its circumference, while the radius arm 12 has a base line 36 designed to align the angle being measured. The base line 36 is preferably surrounded by five markings on either side to enhance reading the measurement of an angle to within one degree.

To measure an angle with the invention, the user aligns the pivot point 56 with the vertex of the angle, and aligns a first side of the angle with the base line 36. The user then rotates the circular member 40 until the 0° line 46 on the circular member 40 is aligned with the base line 36. Then, the user visually notes the degree mark at which the second side of the angle intersects. This degree mark is the angle's measurement. Alternatively, the user aligns the 0° line 46 of the circular member 40 with the first side of the angle and rotates the radius arm 12 until its base line 36 is aligned with the second side of the angle. Then, the user visually notes the degree mark and thus the angle's measurement.

The invention is thus capable of measuring degrees between 0° and 360° both during and after a circle, arc or angle is formed with the invention.

The invention may also be used to draw an arc of a circle of a predetermined radius. For instance, a 30° arc of a circle of a radius 2½" is drawn by first sliding the sliding member 28 so that the hole 38 aligns with 2½" of the measuring indicia 26, and then locking the locking means 32 in place. The user then rotates the rotatably attached member 40 so that the 0° line 46 aligns with the horizontal line 36. The pivot point 56 and the rotatably attached member 40 are then held in place against the surface. A marking instrument is then inserted into the hole 38 and rotated counterclockwise. When the horizontal line 36 reaches the 30° line of the measurement indicia 42, a 30° arc of radius 2½" has been drawn.

To draw a 30° angle, the user first draws a straight line or ray using a straight edge 24. Then, the user centers the pivot point 56 with the end point of the ray and aligns the 0° line 46 with the ray. The horizontal line 36 is then aligned with the 30° line of the measurement indicia 42. A tick mark may then be made by inserting a marking instrument through both holes 30, 38. The straight edge 24 is then used to connect these two points to the endpoint of the ray, forming a 30° angle.

The invention may also be used to form pie graphs. If the user knows the percentages to be indicated by the slices or sectors of the pie, the user calculates the number of degrees equivalent to each percentage. For instance, if the pie graph is to indicate 25% A, 25% B, and 50% C, then the user would calculate 90° for A (25% of 360°), 90 ° for B, and 180° for C (50% of 360°). The user then draws a small mark to indicate the center of the circle. The user selects a radius length and either locks the selected radius on the radius arm or uses one of the plurality of radius holes 44 in combination with aligning the pivot point 56 via the crosshairs 58 over the small mark to draw a circle of the selected radius. Without removing the device from the paper or other underlying surface, the user makes tick marks for 0°, 90°, and 180° without the need of a separate protractor. Then, the user uses one of the straight edges 24 and 25 to draw lines from the center of the circle through the three tick marks, resulting in a pie graph.

It will be evident from the foregoing description, that the invention will allow its users to measure while they draw arcs, angles, and sectors. Users also have the freedom to rotate and measure angles while drawing arcs and sectors. This invention is useful for making geometric drawings or constructions previously done with a compass, protractor and straightedge. Additionally, the invention is useful for making pie graphs.

It should be recognized that, while the invention has been described in relation to a preferred embodiment, those skilled in the art may develop a wide variation of structural details without departing from the principles of the invention. Accordingly, the appended claims are to be construed to cover all equivalents falling within the scope and spirit of the invention.

The invention claimed is:

1. A device for geometric construction with a marking instrument, the device comprising:

a radius arm, said radius arm including a means for receiving the marking instrument and a disc having a pivot point; and a rotatable member attached to the radius arm around the disc, the rotatable member being movable through 360° about said disc and having indicia for measuring degrees between 0° and 360°.

2. The device of claim 1, wherein the receiving means is adjustably spaced from the pivot point.

3. The device of claim 2, wherein the device further comprises an elongated opening within the radius arm, said opening having a length, and the receiving means comprises a sliding member movable along the length of the elongated opening and having at least one hole for receiving the marking instrument.

4. The device of claim 3, wherein said radius arm further comprises two straight edges substantially parallel with the elongated opening and measuring indicia along at least one of the two straight edges.

5. The device of claim 4, wherein said measuring indicia are selected from the group consisting of English, metric, and a combination of English and metric measurements.

6. The device of claim 4, wherein the sliding member includes at least one pointer to indicate one of the indicia.

7. The device of claim 6, wherein the sliding member includes two pairs of pointers and two holes, each of said holes between a pair of pointers.

8. The device of claim 3, wherein said sliding member further comprises a locking means to hold the sliding member in place along the elongated opening.

9. The device of claim 8, wherein said locking means is a screw and nut.

10. The device of claim 1, wherein the pivot point can releasably engage a surface.

11. The device of claim 1, wherein the rotatable member further comprises at least one radius hole in the rotatable member for receiving the marking instrument.

12. The device of claim 11, wherein the rotatable member has a plurality of radius holes.

13. A device for geometric construction with a marking instrument, the device comprising:

a radius arm, said radius arm including a means for receiving the marking instrument and a disc having a pivot point; and a rotatable member attached to the radius arm around the disc, the rotatable member being movable through 360° about said disc and having indicia for measuring degrees between 0° and 360°;

wherein the disc comprises a top part and a bottom part, the top part and the bottom part attaching together the rotatable member and the radius arm.

14. The device of claim 13, wherein the top part and the bottom part snap fit together through a first hole in the rotatable member and a second hole in the radius arm.

15. The device of claim 13 wherein the disc is substantially transparent and the bottom part has a pivot point and crosshairs aligned through the pivot point.

16. The device of claim 13 wherein the radius arm has a bottom, and wherein the bottom part of the disc is substantially coplanar with the bottom of the radius arm.

17. A device for geometric construction with a marking instrument, the device comprising:

a radius arm, said radius arm including a disc having a pivot point, and a means for receiving the marking instrument, wherein the receiving means is adjustably spaced from the pivot point, and the radius arm further comprises an elongated opening within the radius arm, said opening having a length, two straight edges substantially parallel with the elongated opening, measuring indicia along at least one of the two straight edges; and a sliding member movable along the length of the elongated opening, said sliding member including two pairs of pointers and two holes for receiving the marking instrument, each of said holes between a pair of pointers, said pointers indicating one of the measuring indicia, and said sliding member further comprising a locking means to hold the sliding member in place along the elongated opening; and a rotatable member attached to the radius arm around the disc, the rotatable member being movable through 360° about said disc and having indicia for measuring degrees between 0° and 360°, the rotatable member further comprising at least one radius hole in the rotatable member for receiving the marking instrument, wherein the disc comprises a top part and a bottom part, the top part and the bottom part rotatably attaching together the rotatable member and the radius arm.

18. The device of claim 17 wherein the radius arm has a bottom, and wherein the bottom part of the disc is substantially coplanar with the bottom of the radius arm.

* * * * *